US010053323B2

(12) United States Patent
Albers et al.

(10) Patent No.: US 10,053,323 B2
(45) Date of Patent: Aug. 21, 2018

(54) SHEET HANDLING APPARATUS WITH ROTARY DRUM

(71) Applicant: Océ Holding B.V., Venlo (NL)

(72) Inventors: Antonius G. H. Albers, Venlo (NL); Johannes H. L. Smeyers, Venlo (NL); Albert M. Van Beek, Venlo (NL); Marcel J. H. M. Haenen, Venlo (NL); Wilhelmus H. J. Nellen, Venlo (NL)

(73) Assignee: OCÉ HOLDING B.V., Venlo (NL)

( * ) Notice: Subject to any disclaimer, the term of this patent is extended or adjusted under 35 U.S.C. 154(b) by 0 days.

(21) Appl. No.: 15/687,123

(22) Filed: Aug. 25, 2017

(65) Prior Publication Data

US 2018/0065825 A1 Mar. 8, 2018

(30) Foreign Application Priority Data

Sep. 2, 2016 (EP) ..... 16186916

(51) Int. Cl.
*B65H 29/24* (2006.01)
*B65H 37/00* (2006.01)
(Continued)

(52) U.S. Cl.
CPC ..... *B65H 29/243* (2013.01); *B41J 13/226* (2013.01); *B65H 5/226* (2013.01);
(Continued)

(58) Field of Classification Search
CPC .. B65H 29/243; B65H 37/00; B65H 2801/03; B65H 2406/3122; B65H 2406/33
See application file for complete search history.

(56) References Cited

U.S. PATENT DOCUMENTS 5,329,301 A * 7/1994 Balzeit ..... H04N 1/047 271/194
6,332,665 B1 12/2001 Mantell et al.
(Continued)

FOREIGN PATENT DOCUMENTS

CH 238698 8/1945
DE 198 47 923 C1 3/2000
(Continued)

OTHER PUBLICATIONS

European Search Report for EP 16 18 6916, dated Feb. 16, 2017.
European Search Report dated Jan. 17, 2018 for Application No. 17187960.

*Primary Examiner* — Thomas A Morrison
(74) *Attorney, Agent, or Firm* — Birch, Stewart, Kolasch & Birch, LLP

(57) ABSTRACT

A sheet handling apparatus for a printing system includes a rotary drum having an inner chamber circumferentially surrounded by an outer peripheral wall with perforations formed therein. By means of sucking an air flow through the perforations of the drum to a suction system, sheets are attracted to the peripheral wall of the drum. A stationary shutter member is positioned inside the inner chamber for blocking the flow of air through the perforations when they pass, with the rotation of the drum, through a first predetermined angular range. The shutter member includes protrusions while the rotary drum includes recesses for receiving the protrusions, such that a meandering air flow passage is formed between the shutter member and the rotary drum. As such, friction between the rotary drum and the stationary shutter member is reduced, thereby reducing the power consumption of the suction system.

18 Claims, 6 Drawing Sheets

(51) Int. Cl.
*B41J 13/22* (2006.01)
*B65H 5/22* (2006.01)

(52) U.S. Cl.
CPC ..... *B65H 37/00* (2013.01); *B65H 2301/517* (2013.01); *B65H 2406/364* (2013.01); *B65H 2406/3614* (2013.01); *B65H 2801/03* (2013.01)

(56) References Cited

U.S. PATENT DOCUMENTS

| | | | | |
|---|---|---|---|---|
| 6,702,277 | B1 | 3/2004 | Gaffal | |
| 8,162,427 | B2 * | 4/2012 | Fukui | B41J 29/38 347/104 |
| 2009/0295898 | A1 | 12/2009 | Takatsuka | |
| 2016/0152046 | A1 * | 6/2016 | Hollands | B65H 81/00 347/102 |

FOREIGN PATENT DOCUMENTS

| | | | |
|---|---|---|---|
| EP | 3 020 666 | A1 | 5/2016 |
| WO | WO 91/19613 | A1 | 12/1991 |
| WO | WO 2008/125293 | A1 | 10/2008 |

* cited by examiner

SHEET HANDLING APPARATUS WITH ROTARY DRUM

BACKGROUND OF THE INVENTION

1. Field of the Invention

The invention relates to a sheet handling apparatus for a high productivity printing system.

2. Description of Background Art

European Patent application with publication number 3020666 describes a sheet handling apparatus for conveying media sheets in a printer or copier, for example. When the sheets are attracted to the peripheral wall of the drum and the drum rotates, the sheets are conveyed in a circumferential direction of the drum. As the sheets come into intimate contact with the peripheral wall of the drum, the heat conductivity of that wall may be utilized for controlling the temperature of the sheets, i.e. for heating or cooling them. The stationary shutter member has the purpose to interrupt the flow of air through the perforations at a specific angular position, so that the sheets can be detached from the drum more easily when they reach that position. In high productivity printing systems (300 sheets per minute or higher), the transport speed of the sheets passing through the printing system is relatively high. In order to increase the time that is available for the heat exchange, a relatively large diameter of the drum is required. This ensures that the dwell time of the sheets on the surface of the drum is sufficiently long for drying or cooling the sheets.

In such an apparatus with a large drum, it has therefore been preferred to use a segmented drum having a plurality of chambers distributed over the periphery of the drum, and a suction system that is connected to said chambers via a disk-shaped manifold provided at an axial end of the drum. The manifold comprises a plurality of radially extending channels for transporting the air from the chambers at the periphery of the drum radially inwards to a suction opening near the rotation axis of the drum. A drawback of the apparatus in EP3020666 is that is relatively complex. A further drawback is that the air resistance between the suction system and the vacuum holes in the peripheral wall is relatively high. A powerful vacuum pump or fan is required to achieve a sufficiently large suction force to create proper suction at the vacuum holes in the peripheral wall.

SUMMARY OF THE INVENTION

It is an object of the invention to provide an improved drum-type sheet handling apparatus for a high productivity printing system, wherein operating costs are reduced.

Thereto, the present invention provides a sheet handling apparatus according to claim 1 and a printing system according to claim 15.

The present invention relates to a sheet handling apparatus comprising:

a rotary drum having an inner chamber circumferentially surrounded by an outer peripheral wall with perforations formed therein;

a suction system for controlling a flow of air through the perforations of the drum, thereby to attract sheets to the peripheral wall of the drum; and a shutter member positioned inside the inner chamber for blocking the flow of air through the perforations when they pass, with the rotation of the drum, through a first predetermined angular range, wherein the radially outward surface of the shutter member comprises a plurality of protrusions and a radially inward surface of the rotary drum comprises plurality of recesses for receiving the protrusions, such that a meandering air flow passage is formed between the shutter member and the rotary drum.

It is the insight of the inventors that the air leakage between the rotating drum and the stationary shutter member is reduced by applying a narrow meandering air passage between the two. The air passage positions the drum at a very fine distance from the shutter which removes friction between the drum and the shutter member. Further, the narrow passage comprises a large air resistance greatly reducing the amount of air leaking into the drum. Thus the operational costs for driving the drum are reduced due to the reduced friction and the costs for maintaining are reduced by reducing the air leakage.

The inner chamber connects the suction system to the perforations in the peripheral wall. The majority of the inner chamber is thereby used to distribute the air between the perforations and the suction system. The inner chamber of the rotary drum provides little air resistance during operation, as the inner chamber is substantially vacant. Air flows substantially unimpeded from the perforations to the suction system. In consequence, the sheet handling apparatus has a relatively low air flow resistance.

The shutter member blocks the flow of air through the perforations when they pass through the first predetermined angular range, while air may flow around the shutter member between unblocked perforations and the suction system. As the volume of the shutter member may be relatively small compared to that of the drum, the presence of the shutter member inside the inner chamber has little to limited negative effect on the air flow of the inner chamber. Thus, the air resistance is not substantially affected by the shutter member and therefore remains low.

Further, air is radially distributed inside the drum, while the shutter member is positioned inside the drum for blocking off the perforations in the first angular range. As such, there is no need for a radial distribution manifold, such as shown in EP3020666, which manifold would negatively affect the air resistance of the sheet handling apparatus. As such, the construction of the sheet handling apparatus may be simplified by reducing its weight and costs, while maintaining a low air resistance. The low air resistance reduces the operation costs as less power for generating sufficient suction is required. Friction between the rotating and static components is further reduced, allowing the drum to be driven with reduced power consumption.

The radially outward surface of the stationary shutter member comprises a plurality of protrusions and a radially inward surface of the rotary drum comprises plurality of recesses for receiving the protrusions, such that a meandering air flow passage is formed between the stationary shutter member and the rotary drum. The protrusions are positioned within the recesses in a contactless manner, such that air may flow between them. In this manner a labyrinth seal is formed between a high pressure region in the shutter member and a low pressure region within the drum. As such, the meandering air flow passage forms an air flow resistance element to prevent substantial amounts of air from flowing from inside the stationary shutter member (or the support member conduit) into the inner chamber of the rotary drum. As drum rotates over the shutter member, the labyrinth seal provides a contactless and thus frictionless seal. Thereby, the operating power for rotating the drum may be kept relatively low. Thereby the object of the present invention has been achieved.

More specific optional features of the invention are indicated in the dependent claims. It will be appreciated that the reduced air flow resistance of the apparatus according to the present invention contributes to an improved holding of the sheets on the drum. The lower air resistance allows for a relatively deeper vacuum at the perforations in the drum, and thereby stronger suction forces for holding the sheet on the drum. The sheets then conform to the shape of the outer surface of the drum, which is preferably smooth. Thereby, any deformation (e.g. wrinkling) of the sheet during drying is minimized, resulting in smooth high quality prints. Further, deformations in the sheets may result in paper jams or 'head touches' with the print heads, resulting in reduced productivity. The reduced air resistance decreases the deformation of the sheets and thereby the risk of paper jams or head touches, thereby increasing productivity. Further, in the apparatus according to the present invention friction between the rotating components such as the drum and stationary components is reduced or minimized, further reducing the power required for driving the drum. Reducing friction also reduces the amount of heat generated due to said friction allowing for a more homogenous temperature distribution through-out the drum and control thereof.

Preferably, meandering herein is defined as the air flow passage having a varying radial distance with respect to the rotation axis of the drum in the direction of said rotation axis. The air flow passage thus repeatedly moves away and towards the rotation axis. In a circumferential view, the air flow passage may be irregular, moving up and down with respect to the rotation axis. Preferably, the meandering is regular or repeating in the axial direction, for example resulting in a serpentine cross-section. Specifically, the cross-section may be oscillating, sine, zig-zag, turning, twisty, snaky etc.

Preferably, the recesses and the protrusions extend angularly over the shutter member and the drum, i.e. in the direction of rotation of the drum. A recess may, in an example, be an angularly or circumferentially extending channel in a surface of the shutter member (or the drum). A protrusion would then be an elevation or rib on the drum (or the shutter member) with a shape corresponding to that of the channel but with reduced dimensions to contactlessly fit inside the channel. Protrusions or recesses on the inside facing surface of the drum are endless, whereas protrusions and recesses on the shutter member extend over a limited angular range or angle, e.g. the first and/or second angular range.

In an embodiment, the meandering air flow passage forms an air flow resistance element to prevent substantial amounts of air from flowing from inside the shutter member into the inner chamber of the rotary drum. In an embodiment, the meandering air flow passage acts as or is substantially a seal between the high pressure region of the shutter member and the inner chamber of the drum. The labyrinth seal has a relatively high local air resistance to reduce the amount of air from leaking into the inner chamber. The air resistance of the labyrinth seal may be controlled by the number of protrusions and recesses as well as by the spacing between said protrusions and recesses. In practice, the seal may be an imperfect seal which acts as a bottleneck or funnel which provides a local resistance to achieve a low passage rate of air into the drum.

In a preferred embodiment, the protrusions and the recesses are respectively spaced apart from one another in an axial direction of the drum. The protrusions may be formed as a plurality of circumferentially extending parallel ribs. The ribs extend over a limited angular range or angle. The ribs preferably posses a rotation symmetry, such that the ribs are smooth over their angular range. The ribs are spaced apart to allow each rib to enter its respective recess or channel on the inside surface of the drum. The ribs may be joined together at a common, but their radially outer ends are spaced apart, such that a protrusion between two adjacent recesses on the drum may be positioned in between said ends.

In another embodiment, each protrusion and recess extends over a predefined angle in a circumferential direction of the drum. The angle is preferably the first and/or second predetermined angular range.

In a preferred embodiment, each protrusion is shaped to contactlessly fit into a corresponding recess. In its assembled state, the shutter member is positioned such that each protrusion fits into a recess. Each protrusion or rib comprises a cross-section (along an axial plane) with shape corresponding to the shape of cross-section of the oppositely positioned recess or channel. The shape of the cross-section of the recess is slightly larger than the cross-section of the protrusion in order to space these two components slight apart from one another. The contour of a protrusion contactlessly follows or corresponds to the shape of a recess to define the air flow passage. In a further embodiment, the meandering air flow passage spaces the radially inward surface of the drum apart from the shutter member by a narrow distance of preferably less than 5 mm, very preferably less than 3 mm, even more preferably less than 2 mm, and particularly preferably less than 1 mm.

In a preferred embodiment, the shutter member is stationary in the rotation direction of the drum. The angular position of the shutter member is then stationary or fixed, such that the drum rotates with respect to and over the shutter member. Angularly fixing the position of the shutter member allows for accurate control of the angular range over which perforations in the drum are blocked. Thereby, the releasing and transferring of the sheets may be performed in an efficient and reliable manner. The shutter member is preferably further stationary in the axial direction (or even fully fixed in all degrees of freedom), though in another embodiment the shutter member may be moveable in the radial direction. The shutter member may then be provided with urging means for urging the shutter member towards the outer surface of the drum. The urging means may be a spring system driving the shutter member against or in close proximity to the radially inward surface of the drum to minimize air escaping from or entering into a crevasse or opening between the shutter member and the radially inner surface of the drum. This ensures that the vacuum in the inner chamber of the drum is not negatively affected.

Preferably, the drum is formed as an integral body by e.g. moulding or machine engineering. In another embodiment, the drum is formed of relatively thin or light weight materials, reducing the weight and costs of the sheet handling apparatus. The reduced weight advantageously allows for an easier control of the drum. Since, there is no need for a separate radial manifold the number of components of the sheet handling apparatus is reduced, which allows for a simplified assembly of the apparatus.

In a further embodiment, the rotary drum is rotatably supported on a stationary frame of the sheet handling apparatus, and a (angularly) stationary support member extends inside the drum to connect the stationary shutter member inner side the rotary drum to the stationary frame. The drum rotates with respect to the stationary or static frame. Thereto, the drum is supported on bearing elements, which rotatably support the drum. The support member positions the shutter member near or adjacent the inner side of the peripheral wall of the drum. The support member is configured to fix the position of the shutter member with respect to the stationary frame. The support member, which may comprise one or more support bodies, bars, rods, and/or plates provides a rigid connection between the frame and the shutter member. The support member supports the shutter member inside the drum without substantially affecting the air resistance of the sheet handling apparatus. The drum thus rotates over the shutter member which blocks the air flow through the perforations in the peripheral wall over a predetermined angular range. Since the shutter member is stationary with respect to the frame, the blocked off angular range is similarly static with respect to the frame. The blocked off region is thus accurately defined with respect to a transport path of the printing system. A sheet may thereby be accurately transferred from the rotary drum onto a further transport path, such as a transport belt or another type of linear conveyor mechanism.

In a preferred embodiment, the rotary drum is rotatably supported on a stationary rotation axis, wherein the stationary support member connects the stationary shutter member to the stationary axis. The drum is rotatable around the stationary rotation axis, such that the drum rotates with respect to the stationary frame of the sheet handling apparatus or printing system. The rotation axis extends co-axially through the drum. The rotation axis is static with respect to the frame, and may for example be rigidly connected thereto. It will be appreciated that the apparatus according to the present invention may comprise a positioning mechanism for accurately positioning and fixing the shutter member inside and with respect to the drum. The positioning mechanism may be comprised in the stationary rotation axis and/or the support member.

In another embodiment, the rotary drum is rotatably supported on a stationary rotation axis, wherein the stationary support member connects the stationary shutter member to the stationary axis. The support member is rigidly connected to the rotation axis. The support member (or members) preferably then extends radially from the rotation axis for positioning the shutter member adjacent the peripheral wall. Preferably, the rotation axis and/or the support member are dimensioned or configured to reduce or eliminate vibrations of the shutter member with respect to the drum. This relatively simple construction allows for quick assembly and reduced material costs without increasing the air resistance of the sheet handling apparatus. It will be appreciated that a positioning mechanism may be provided, e.g. on the support member, to controllably move, accurately position and fix the shutter member with respect to the drum during assembly of the apparatus according to the present invention.

In a further embodiment, the rotary drum further comprises a flange at each axial end of the rotary drum, wherein one of the flanges comprises a suction opening for connecting the inner chamber to the suction system. The drum is formed as a cylinder sealed at either axial end by a circular end plate or flange. Preferably, the drum is substantially sealed or airtight, such that during operation air in enters the inner chamber of the drum (preferably only) via the perforations in the peripheral wall and air exits the inner chamber (preferably only) via the suction opening. This prevents ambient air from leaking into the inner chamber and negatively affecting the vacuum pressure in the inner chamber. The inner chamber provides a fluid connection between the perforations and the suction system. Excluding leak air further contributes to a low energy consumption of the sheet handling apparatus according to the present invention.

In a preferred embodiment, the rotation axis extends into the inner chamber through the suction opening. As the drum rotates with respect to the suction system, a frictional force is present where the drum rotates over a stationary connection element which connects the suction system to the suction opening in the drum. Such a connection element may be a pipe, hose, or any other type of conduit for directing air to the suction system. The friction force acts opposite the driving force of an actuator for rotating the drum, thereby increasing the power required for driving the drum. The friction force is proportional to the contact area between the engaging components. By positioning the suction opening radially closer or near the rotation axis, this contact area (which is proportional to its diameter), and thereby the friction force, is reduced. By positioning the suction opening co-axially with and around the rotation axis, the friction force is reduced or even minimized, resulting in low energy consumption. It will be appreciated that the suction opening may be partially closed by a one or more support sections for supporting the drum on the rotation axis.

In a further preferred embodiment, the sheet handling apparatus according to the present invention further comprises a pressure source for introducing compressed air into the stationary shutter member. The stationary shutter member is thus arranged for providing a flow of air through the perforations when they pass, with the rotation of the drum, through a second predetermined angular range. The sheet handling apparatus, specifically the shutter member, may include an air supply system for introducing air into those perforations which are to be shut-off. This permits to reduce a possible residual vacuum which may present at the perforation passing through the first angular range. Optionally, air may be blown actively into some of the perforations via the shutter member so as to actively blow-off the leading edges of the sheets from the surface of the drum. It will be appreciated that in an embodiment the second angular range may (partially) overlap or be similar (or equal) to the first angular range. Alternating blowing and blocking zones or angular regions may in an embodiment further be provided on the shutter member.

In an embodiment, the suction system is configured to form an under-pressure in the inner chamber of the drum. The inner chamber provides a fluid connection between the perforations in the outer surface of the drum and the suction system, such that air is sucked in through perforations into the inner chamber. The pressurized air from the pressure source proceeds to the shutter member substantially isolated from the inner chamber. This prevents the over-pressure from the pressure source from affecting the under-pressure in the inner chamber. The meandering air flow passage between the shutter member and the drum further prevents substantial amounts of pressurized air from leaking into the inner chamber. The air flow passage acts as a local high air resistance barrier between the under-pressure section of the inner chamber of the drum and the over-pressure section extending to and through the shutter member.

In another embodiment, the apparatus according to the present invention comprises a support member conduit for providing an air flow from a pressure source to the stationary shutter member. The support member conduit may be formed by a pipe or hose connecting the rotation axis conduit to the shutter member. The pressure source is preferably positioned outside the drum, while the support member conduit extends inside the inner chamber, for example over an outer surface of the support member. In a preferred embodiment, the support member is configured as a hollow support member, such that air may flow through it from the pressure source to the shutter member. The support member conduit is preferably sealed with respect to the inner chamber to prevent air from leaking into the inner chamber and negatively affecting the vacuum pressure there.

In a further embodiment, the stationary rotation axis comprises an axis conduit in fluid connection with the support member conduit for providing an air flow from a pressure source to the stationary shutter member. The rotation axis may be a hollow axis connected to the pressure source. The axis conduit is in fluid connection to the pressure source positioned outside the drum. The axis conduit transports the air from the pressure source into the drum, but sealed off from the inner chamber. Inside the drum the axis conduit connects to the support member conduit to bring the air to the shutter member, without said air leaking into the inner chamber. As such, shut-off perforations in the first and/or second angular range may be pressurized to blow leading edge sections of sheets away from the outer peripheral wall of the drum without affecting the vacuum pressure inside the drum.

In a further preferred embodiment, the sheet handling apparatus according to the present invention further comprises a sheet treatment system for drying sheets on the rotary drum. The sheet handling apparatus according to the present in invention is preferably positioned downstream of an image forming apparatus for printing an image upon a sheet. The ink of the image deposited on the sheet requires drying before said sheet can be output or flipped for duplex printing. Thereto, the sheet treatment system aids in treating the sheet for example by heating the printed sheet by irradiation or heated air. Advantageously moisture is extracted from the sheet via the perforations and evacuated via the inner chamber to the suction system.

In a further aspect, the present invention provides a printing system comprising a sheet handling apparatus according to present invention.

In an even further aspect, the present invention provides a method for transporting sheets, comprising:

- transporting sheet onto a rotary drum having an inner chamber circumferentially surrounded by an outer peripheral wall with perforations formed therein;
- attracting the sheets to the peripheral wall of the drum by controlling a flow of air through the perforations of the drum;
- blocking the flow of air through the perforations when they pass, with the rotation of the drum, through a first predetermined angular range by a shutter member positioned inside the inner chamber. By positioning the shutter member inside the hollow drum, substantially the entire volume of the inner chamber may be used to provide a fluid connection between the perforations in the outer peripheral wall and the suction system. Due to its relatively large and substantially vacant volume, the air flow resistance of the drum is low. Due to the reduced air flow resistance, the requirements for the suction system are also reduced. This in turn results in a low power operation of the sheet handling apparatus according to the present invention. Thereby, the object of the present invention has been achieved.

Preferably, the shutter member is angularly fixed or stationary.

In an embodiment, the method further comprises the step introducing compressed air into the stationary shutter member for providing a flow of air through the perforations when they pass, with the rotation of the drum, through a second predetermined angular range. The shutter member is thus arranged for blowing leading edges of sheet on the rotary drum away from the drum. The second angular range is preferably angularly adjacent to the first angular range, specifically directly before the first angular range as seen in the direction of rotation of the drum. The second range for blowing away sheets enables fast and reliable transfer of the sheets onto a further transport mechanism, such as a belt or rollers.

In a further aspect, the present invention provides a method for treating a sheet, comprising the step of drying a sheet, while the sheet is transported by means of a method for transporting sheets according to the present invention. Printed sheets need to be dried prior to outputting or further printing of said sheets. To maintain high productivity such drying is combined with transporting the sheets, such that the sheets are dried on a transport path to an output device or on a duplex pass to the image forming apparatus. Drying may be performed by irradiation with infrared light or exposure to dry and/or heated air. The sheets may also be heated by contact with drum, which acts as a heat reservoir. Excess heat from the drum is distributed to the sheets, while, when the drum is at a lower temperature than the sheets, heat is distributed from the sheets into the drum. Additionally, moisture is sucked away via the perforations into the drum to aid in the drying process.

In an even further aspect, the present invention provides a use of the apparatus according to the present invention in any of the above described methods.

Further scope of applicability of the present invention will become apparent from the detailed description given hereinafter. However, it should be understood that the detailed description and specific examples, while indicating preferred embodiments of the present invention, are given by way of illustration only, since various changes and modifications within the spirit and scope of the present invention will become apparent to those skilled in the art from this detailed description.

BRIEF DESCRIPTION OF THE DRAWINGS

The present invention will become more fully understood from the detailed description given herein below and the accompanying drawings which are given by way of illustration only, and thus are not limitative of the present invention, and wherein:

FIG. 2A) and FIG. 2B) assembly of inkjet heads; FIG. 2C) detailed view of a part of the assembly of inkjet heads;

DETAILED DESCRIPTION OF THE PREFERRED EMBODIMENTS

Figure 1:
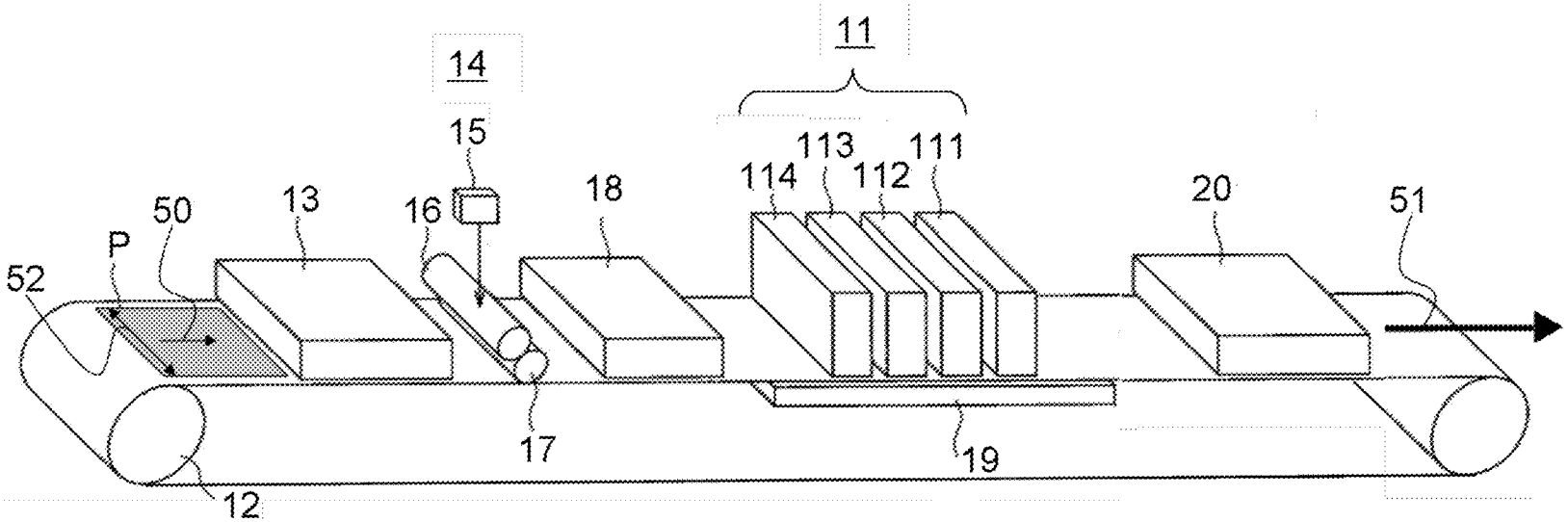
FIG. 1 shows a schematic representation of an inkjet printing system.

The present invention will now be described with reference to the accompanying drawings, wherein the same reference numerals have been used to identify the same or similar elements throughout the several views.

Printing Process

A printing process in which the inks according to the present invention may be suitably used is described with reference to the appended drawings shown in FIG. 1 and FIGS. 2A-2C. FIG. 1 and FIGS. 2A-2C show schematic representations of an inkjet printing system and an inkjet marking device, respectively.

FIG. 1 shows that a sheet of a receiving medium, in particular a machine coated medium, P, is transported in a direction for conveyance as indicated by arrows 50 and 51 and with the aid of transportation mechanism 12. Transportation mechanism 12 may be a driven belt system comprising one (as shown in FIG. 1) or more belts. Alternatively, one or more of these belts may be exchanged for one or more drums. A transportation mechanism may be suitably configured depending on the requirements (e.g. sheet registration accuracy) of the sheet transportation in each step of the printing process and may hence comprise one or more driven belts and/or one or more drums. For a proper conveyance of the sheets of receiving medium, the sheets need to be fixed to the transportation mechanism. The way of fixation is not particularly limited and may be selected from electrostatic fixation, mechanical fixation (e.g. clamping) and vacuum fixation. Of these vacuum fixation is preferred.

The printing process as described below comprises of the following steps: media pre-treatment, image formation, drying and fixing and optionally post treatment.

Media Pre-Treatment

To improve the spreading and pinning (i.e. fixation of pigments and water-dispersed polymer particles) of the ink on the receiving medium, in particular on slow absorbing media, such as machine coated media, the receiving medium may be pretreated, i.e. treated prior to printing an image on the medium. The pre-treatment step may comprise one or more of the following:

- preheating of the receiving medium to enhance spreading of the used ink on the receiving medium and/or to enhance absorption of the used ink into the receiving medium;
- primer pre-treatment for increasing the surface tension of receiving medium in order to improve the wettability of the receiving medium by the used ink and to control the stability of the dispersed solid fraction of the ink composition (i.e. pigments and dispersed polymer particles). Primer pre-treatment may be performed in the gas phase, e.g. with gaseous acids such as hydrochloric acid, sulfuric acid, acetic acid, phosphoric acid and lactic acid, or in the liquid phase by coating the receiving medium with a pre-treatment liquid. The pre-treatment liquid may comprise water as a solvent, one or more cosolvents, additives such as surfactants and at least one compound selected from a polyvalent metal salt, an acid and a cationic resin;
- corona or plasma treatment.

Primer Pre-Treatment

As an application way of the pre-treatment liquid, any conventionally known methods can be used. Specific examples of an application way include: a roller coating, an ink-jet application, a curtain coating and a spray coating. There is no specific restriction in the number of times with which the pre-treatment liquid is applied. It may be applied at one time, or it may be applied in two times or more. Application in two times or more may be preferable, since cockling of the coated printing paper can be prevented and the film formed by the surface pre-treatment liquid will produce a uniform dry surface having no wrinkle by applying in 2 steps or more.

Especially a roller coating (see 14 in FIG. 1) method is preferable because this coating method does not need to take into consideration of ejection properties and it can apply the pre-treatment liquid homogeneously to a recording medium. In addition, the amount of the applied pre-treatment liquid with a roller or with other means to a recording medium can be suitably adjusted by controlling: the physical properties of the pre-treatment liquid; and the contact pressure of a roller in a roller coater to the recording medium and the rotational speed of a roller in a roller coater which is used for a coater of the pre-treatment liquid. As an application area of the pre-treatment liquid, it may be possible to apply only to the printed portion, or to the entire surface of both the printed portion and the non-printed portion. However, when the pre-treatment liquid is applied only to the printed portion, unevenness may occur between the application area and a non-application area caused by swelling of cellulose contained in the coated printing paper with the water in the pre-treatment liquid followed by drying. Then, from the viewpoint of drying uniformly, it is preferable to apply a pre-treatment liquid to the entire surface of a coated printing paper, and roller coating can be preferably used as a coating method to the whole surface. The pre-treatment liquid may be an aqueous pre-treatment liquid.

Corona or Plasma Treatment

Corona or plasma treatment may be used as a pre-treatment step by exposing a sheet of a receiving medium to corona discharge or plasma treatment. In particular when used on media like polyethylene (PE) films, polypropylene (PP) films, polyethyleneterephthalate (PET) films and machine coated media, the adhesion and spreading of the ink can be improved by increasing the surface energy of the media. With machine coated media, the absorption of water can be promoted which may induce faster fixation of the image and less puddling on the receiving medium. Surface properties of the receiving medium may be tuned by using different gases or gas mixtures as medium in the corona or plasma treatment. Examples are air, oxygen, nitrogen, carbondioxide, methane, fluorine gas, argon, neon and mixtures thereof. Corona treatment in air is most preferred.

FIG. 1 shows that the sheet of receiving medium P may be conveyed to and passed through a first pre-treatment module 13, which module may comprise a preheater, for example a radiation heater, a corona/plasma treatment unit, a gaseous acid treatment unit or a combination of any of the above. Optionally and subsequently, a predetermined quantity of the pre-treatment liquid is applied on the surface of the receiving medium P at pre-treatment liquid applying member 14. Specifically, the pre-treatment liquid is provided from storage tank 15 of the pre-treatment liquid to the pre-treatment liquid applying member 14 composed of double rolls 16 and 17. Each surface of the double rolls may be covered with a porous resin material such as sponge. After providing the pre-treatment liquid to auxiliary roll 16 first, the pre-treatment liquid is transferred to main roll 17, and a predetermined quantity is applied on the surface of the receiving medium P. Subsequently, the coated printing paper P on which the pre-treatment liquid was supplied may optionally be heated and dried by drying member 18 which is composed of a drying heater installed at the downstream position of the pre-treatment liquid applying member 14 in order to decrease the quantity of the water content in the pre-treatment liquid to a predetermined range. It is preferable to decrease the water content in an amount of 1.0 weight % to 30 weight % based on the total water content in the provided pre-treatment liquid provided on the receiving medium P.

To prevent the transportation mechanism 12 being contaminated with pre-treatment liquid, a cleaning unit (not shown) may be installed and/or the transportation mechanism may be comprised multiple belts or drums as described above. The latter measure prevents contamination of the upstream parts of the transportation mechanism, in particular of the transportation mechanism in the printing region.

Image Formation

Image formation is performed in such a manner that, employing an inkjet printer loaded with inkjet inks, ink droplets are ejected from the inkjet heads based on the digital signals onto a print medium.

Although both single pass inkjet printing and multi pass (i.e. scanning) inkjet printing may be used for image formation, single pass inkjet printing is preferably used since it is effective to perform high-speed printing. Single pass inkjet printing is an inkjet recording method with which ink droplets are deposited onto the receiving medium to form all pixels of the image by a single passage of a receiving medium underneath an inkjet marking module.

In FIG. 1, 11 represents an inkjet marking module comprising four inkjet marking devices, indicated with 111, 112, 113 and 114, each arranged to eject an ink of a different color (e.g. Cyan, Magenta, Yellow and blacK). The nozzle pitch of each head is e.g. about 360 dpi. In the present invention, "dpi" indicates a dot number per 2.54 cm.

Figure 2A:
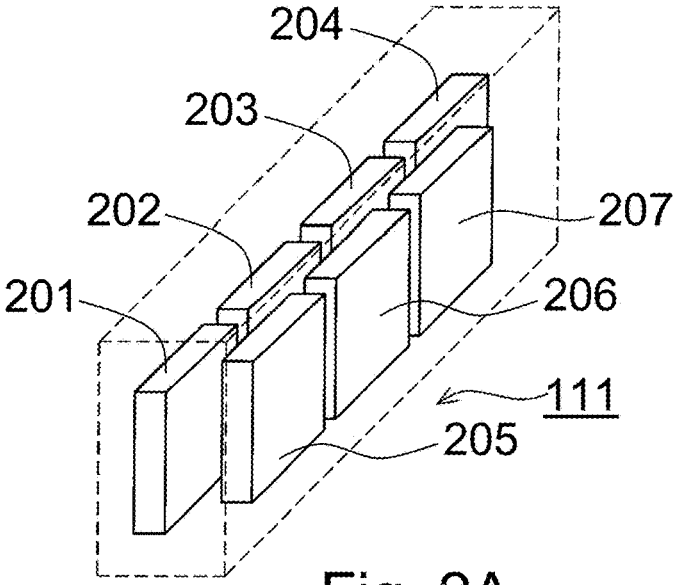
FIGS. 2A-2C show schematic representations of an inkjet marking device.
Figure 2B:
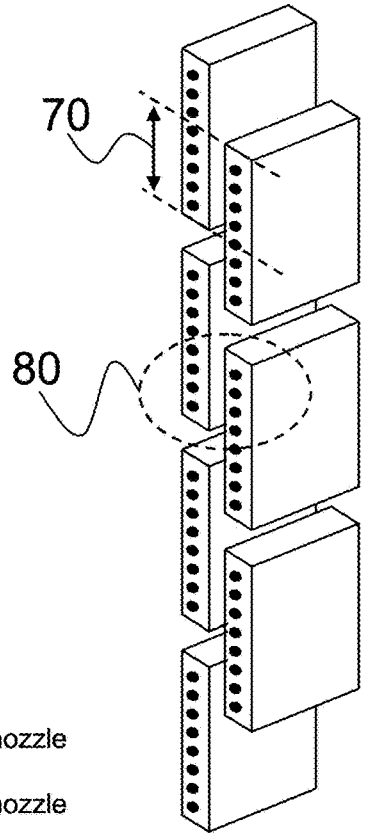
Figure 2C:
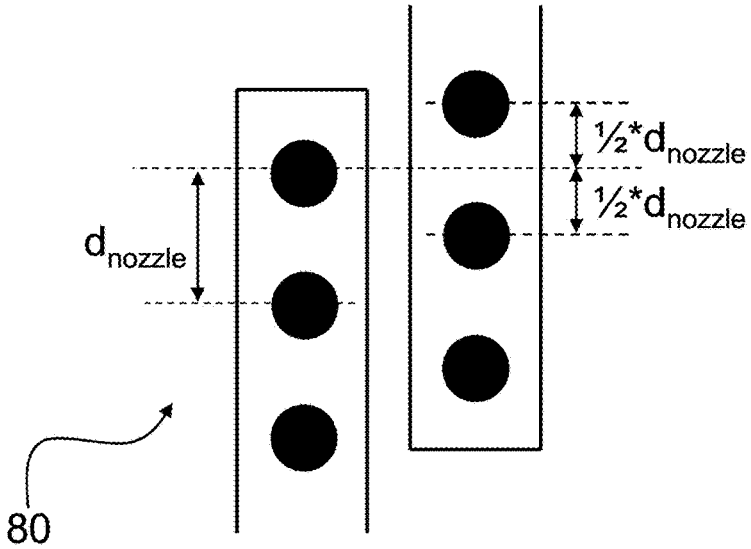

An inkjet marking device for use in single pass inkjet printing, 111, 112, 113, 114, has a length, L, of at least the width of the desired printing range, indicated with double arrow 52, the printing range being perpendicular to the media transport direction, indicated with arrows 50 and 51. The inkjet marking device may comprise a single printhead having a length of at least the width of said desired printing range. The inkjet marking device may also be constructed by combining two or more inkjet heads, such that the combined lengths of the individual inkjet heads cover the entire width of the printing range. Such a constructed inkjet marking device is also termed a page wide array (PWA) of printheads. FIG. 2A shows an inkjet marking device 111 (112, 113, 114 may be identical) comprising 7 individual inkjet heads (201, 202, 203, 204, 205, 206, 207) which are arranged in two parallel rows, a first row comprising four inkjet heads (201-204) and a second row comprising three inkjet heads (205-207) which are arranged in a staggered configuration with respect to the inkjet heads of the first row. The staggered arrangement provides a page wide array of nozzles which are substantially equidistant in the length direction of the inkjet marking device. The staggered configuration may also provide a redundancy of nozzles in the area where the inkjet heads of the first row and the second row overlap, see 70 in FIG. 2B. Staggering may further be used to decrease the nozzle pitch (hence increasing the print resolution) in the length direction of the inkjet marking device, e.g. by arranging the second row of inkjet heads such that the positions of the nozzles of the inkjet heads of the second row are shifted in the length direction of the inkjet marking device by half the nozzle pitch, the nozzle pitch being the distance between adjacent nozzles in an inkjet head, $d_{nozzle}$ (see FIG. 2C, which represents a detailed view of 80 in FIG. 2B). The resolution may be further increased by using more rows of inkjet heads, each of which are arranged such that the positions of the nozzles of each row are shifted in the length direction with respect to the positions of the nozzles of all other rows.

In image formation by ejecting an ink, an inkjet head (i.e. printhead) employed may be either an on-demand type or a continuous type inkjet head. As an ink ejection system, there may be usable either the electric-mechanical conversion system (e.g., a single-cavity type, a double-cavity type, a bender type, a piston type, a shear mode type, or a shared wall type), or an electric-thermal conversion system (e.g., a thermal inkjet type, or a Bubble Jet type (registered trade name)). Among them, it is preferable to use a piezo type inkjet recording head which has nozzles of a diameter of 30 μm or less in the current image forming method.

FIG. 1 shows that after pre-treatment, the receiving medium P is conveyed to upstream part of the inkjet marking module 11. Then, image formation is carried out by each color ink ejecting from each inkjet marking device 111, 112, 113 and 114 arranged so that the whole width of the receiving medium P is covered.

Optionally, the image formation may be carried out while the receiving medium is temperature controlled. For this purpose a temperature control device 19 may be arranged to control the temperature of the surface of the transportation mechanism (e.g. belt or drum) underneath the inkjet marking module 11. The temperature control device 19 may be used to control the surface temperature of the receiving medium P, for example in the range of 30° C. to 60° C. The temperature control device 19 may comprise heaters, such as radiation heaters, and a cooling means, for example a cold blast, in order to control the surface temperature of the receiving medium within said range. Subsequently and while printing, the receiving medium P is conveyed to the down stream part of the inkjet marking module 11.

Post Treatment

To increase the print robustness or other properties of a print, such as gloss level, the print may be post treated, which is an optional step in the printing process.

In an embodiment, the prints may be post treated by laminating the prints.

In an embodiment, the post-treatment step comprises a step of applying (e.g. by jetting) a post-treatment liquid onto the surface of the coating layer, onto which the inkjet ink has been applied, so as to form a transparent protective layer on the printed recording medium. In the post-treatment step, the post-treatment liquid may be applied over the entire surface of an image on the recording medium or may be applied only to specific portions of the surface of an image. The method of applying the post-treatment liquid is not particularly limited, and is selected from various methods depending on the type of the post-treatment liquid. However, the same method as used in the coating method of the pre-treatment liquid or an inkjet printing method is preferably used. Of these methods, inkjet printing method is particularly preferable in view of, avoiding contact between the printed image and the used post-treatment liquid applicator; the construction of an inkjet recording apparatus used; and the storage stability of the post-treatment liquid. In the post-treatment step, a post-treatment liquid containing a transparent resin is applied on the surface of a formed image so that a dry adhesion amount of the post-treatment liquid is 0.5 $g/m^2$ to 10 $g/m^2$, preferably 2 $g/m^2$ to 8 $g/m^2$, thereby forming a protective layer on the recording medium. When the dry adhesion amount is less than 0.5 $g/m^2$, almost no improvement in image quality (image density, color saturation, glossiness and fixability) is obtained. When the dry adhesion amount is more than 10 g/m$^2$, it is disadvantageous in cost efficiency, because the dryness of the protective layer degrades and the effect of improving the image quality is saturated.

As a post-treatment liquid, an aqueous solution comprising components capable of forming a transparent protective layer over a recording medium (e.g. a water-dispersible resin, a surfactant, water, and additives as required) is preferably used. The water-dispersible resin comprised in the post-treatment liquid, preferably has a glass transition temperature ($T_g$) of −30° C. or higher, and more preferably in the range of −20° C. to 100° C. The minimum film forming temperature (MFT) of the water-dispersible resin is preferably 50° C. or lower, and more preferably 35° C. or lower. The water-dispersible resin may be radiation curable to improve the glossiness and fixability of the image.

As the water-dispersible resin, for example, an acrylic resin, a styrene-acrylic resin, a urethane resin, an acryl-silicone resin, a fluorine resin and the like are preferably used. The water-dispersible resin can be suitably selected from the same materials as that used for the inkjet ink. The amount of the water-dispersible resin contained, as a solid content, in the protective layer is preferably 1% by mass to 50% by mass.

The surfactant comprised in the post-treatment liquid is not particularly limited and may be suitably selected from those used in the inkjet ink. Examples of the other components of the post-treatment liquid include antifungal agents, antifoaming agents, and pH adjustors.

Hitherto, the printing process was described such that the image formation step was performed in-line with the pre-treatment step (e.g. application of an (aqueous) pre-treatment liquid) and a drying and fixing step, all performed by the same apparatus (see FIG. 1). However, the printing process is not restricted to the above-mentioned embodiment. A method in which two or more machines are connected through a belt conveyor, drum conveyor or a roller, and the step of applying a pre-treatment liquid, the (optional) step of drying a coating solution, the step of ejecting an inkjet ink to form an image and the step or drying an fixing the printed image are performed. It is, however, preferable to carry out image formation with the above defined in-line image forming method.

Drying and Fixing

After an image has been formed on the receiving medium, the prints have to be dried and the image has to be fixed onto the receiving medium. Drying comprises the evaporation of solvents, in particular those solvents that have poor absorption characteristics with respect to the selected receiving medium.

FIG. 1 schematically shows a sheet handling apparatus 20, specifically a drying and fixing unit 20, which may comprise a heater, for example a radiation heater. After an image has been formed, the print is conveyed to and passed through the drying and fixing unit 20. The print is heated such that solvents present in the printed image, to a large extent water, evaporate. The speed of evaporation and hence drying may be enhanced by increasing the air refresh rate in the drying and fixing unit 20. Simultaneously, film formation of the ink occurs, because the prints are heated to a temperature above the minimum film formation temperature (MFT). The residence time of the print in the drying and fixing unit 20 and the temperature at which the drying and fixing unit 20 operates are optimized, such that when the print leaves the drying and fixing unit 20 a dry and robust print has been obtained. As described above, the transportation mechanism 12 in the fixing and drying unit 20 may be separated from the transportation mechanism of the pre-treatment and printing section of the printing apparatus and may comprise a belt or a drum.

Figure 3:
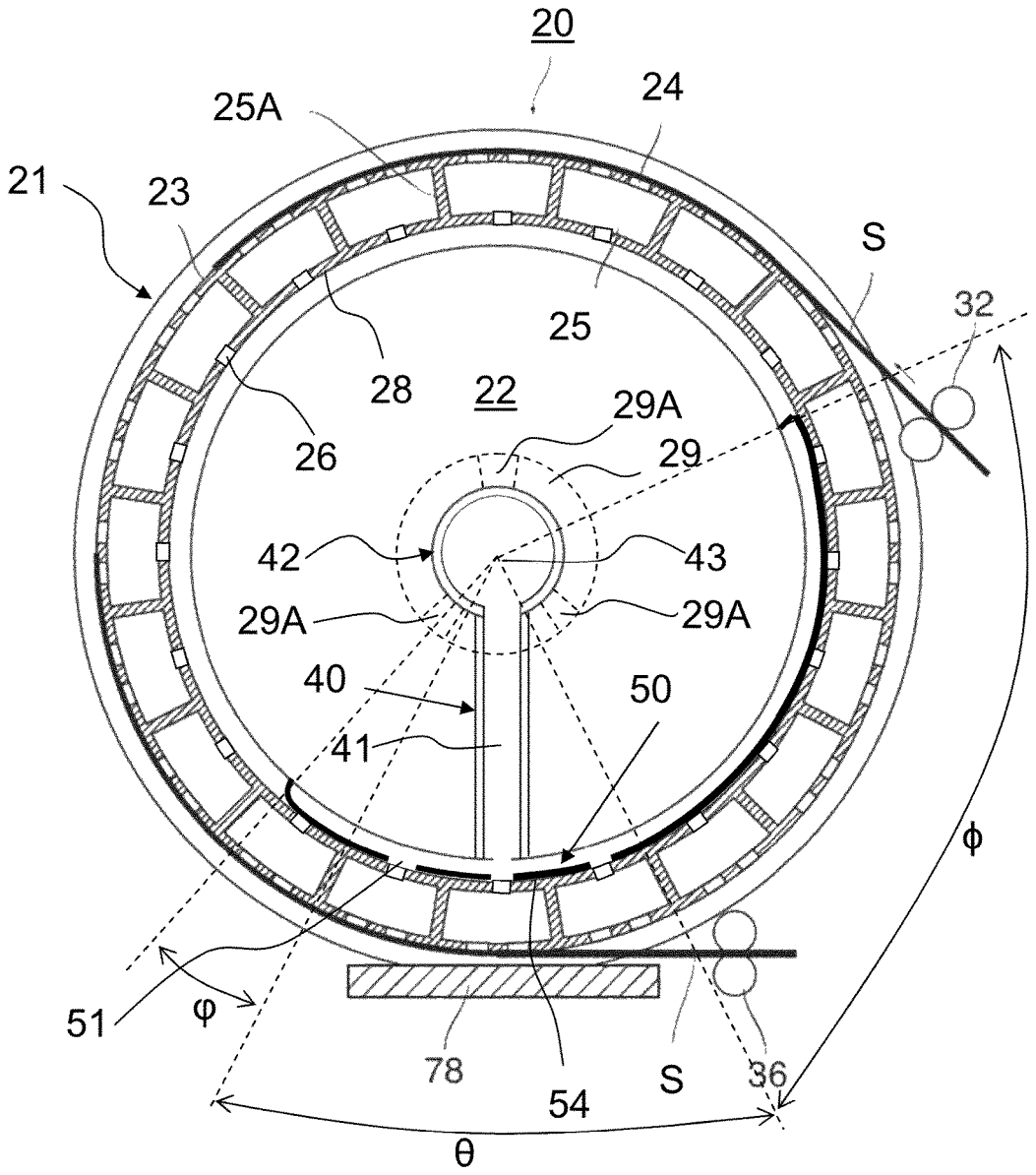
FIG. 3 is a radial cross-sectional view of a sheet handling apparatus according to the present invention.

FIG. 3 shows a sheet handling apparatus 20 which in an embodiment forms the drying and fixing unit 20 of the printing system described in FIG. 1. The sheet handling apparatus 20 comprises a rotary drum 21 that has an outer peripheral wall 23 with perforations 24 formed therein. The drum 21 is mounted on a rotation axis 42, around which the drum 21 may be driven for rotation. The outer peripheral wall 23 together with an inner peripheral wall 28, delimits a number of chambers 25 that extend over the axial length of the drum 21. The chambers or channels 25 are distributed over the periphery of the drum 21 and are separated from one another by radial walls 25A, as can be seen in FIG. 3. The inner peripheral wall 28 comprises openings 26 to provide a fluid connection between the chambers 25 and the inner chamber 22 of the drum 21.

In a flange at an axial end of the drum 21 a suction opening 29 is provided around and co-axially with the rotation axis 42. The suction opening 29 is arranged for connecting the inner chamber 22 of the drum 21 to a suction pipe (not shown) that, together with a blower (not shown), forms a suction system for drawing-in ambient air through the perforations 24 of the peripheral wall 23 of the drum 21. The suction system sucks air through the perforations 24 in the outer peripheral wall 23 into the chambers 25. From the chambers 25, the air is then sucked through the openings 26 in the inner peripheral wall 28 into the inner chamber 22 of the drum 21, and from there through the suction opening 42 to the blower or fan. In FIG. 3, the suction opening 29 is partially occupied or overlapped in the angular direction by three support sections 29A or beams 29A, which allow the drum 21 to be supported on the rotation axis 42. The support sections 29A are connected to the flange. To minimize air resistance the surface of the suction opening 29 covered by the support sections 29A is preferably minimized.

As has been illustrated in FIG. 3, the sheet handling apparatus 20 further comprises a pair of feed rollers 32 arranged to feed sheets S, e.g. media sheets in a printer, onto the outer surface of the peripheral wall 23 of the drum 21, where the sheets S are attracted by the air that is drawn in through the perforations 24.

As the drum 21 rotates counter-clockwise in FIG. 3, the sheets S are conveyed around the drum 21 while being held in intimate contact with the peripheral wall 24.

The drum 21 is made of a material with a high thermal conductivity, e.g. of metal, ensuring a substantially homogeneous temperature through-out the drum 21. Intimate contact between the drum 21 and the sheets S may result in heating of the sheets S. By accurately controlling, the temperature of the drum 21 over preferably its entire surface or volume, the drying of the sheets S may be accurately controlled. Thereby, the drying process or period of the sheets S may be precisely set to the desired conditions to ensure to proper drying while minimizing e.g. deformation or energy consumption.

When the leading edge of a sheet S reaches a release position, in this example at the lower apex of the drum 21, it is detached from the drum 21 and conveyed further by means of another roller pair 36.

In order for the sheet S to be easily detached from the surface of the peripheral wall 23, the suction effect should be removed or at least reduced in at least the angular range $\phi$ (but preferably in the combined range '$\theta+\phi$') of the release position. The range $\phi$ preferably extends between the two transfer rollers 32, 36, wherein sheets S are not present during use. Blocking in this range ϕ prevents substantial amounts of air from being sucked into the inner chamber 21 and reducing the vacuum pressure therein.

To that end, as can be seen in FIG. 3, a stationary shutter member 50 is disposed inside the inner chamber 22 of the drum 21. The shutter member 50 is connected to the rotation axis 42 via the support member 40, such that the shutter member 50 is positioned adjacent the inner peripheral wall 28 of the drum 21. The shutter member 50 is stationary in the angular and axial directions. The shutter member 50 is thus positioned for blocking off the air flow through the perforations 24 in at least the predetermined angular range ϕ by blocking the respective openings 26 of the chambers 25 connected to said perforations 24. The shutter member 50 blocks off air flow through the openings 26 in the inner peripheral wall 28 over a predefined angular range, corresponding or similar to the first angular range ϕ.

In an advantageous embodiment, the sheet handling apparatus 20 is provided with a pressure source (not shown) for blowing out air through an opening 51 of the shutter member 50. The pressure source is positioned outside the drum 21 and is connected to the axis conduit 43 inside of the hollow rotation axis 42. The axis conduit 42 is connected to the support member conduit 41 for transporting the air to the shutter member 50. The air then passes through the shutter member 50 to the opening 51, which is positioned for blowing air into the chamber 25 for perforations 24 positioned in the second angular range θ. The air pressure inside shutter member 50 results in an air jet pushing a leading edge of a sheet S away from the drum 21. The sheet S is received onto a guide plate 78 from where the sheet S may be transported further along a transport path of the printing system.

The shutter member 50 in FIG. 3 has a radially outward surface 54. The radially outward surface 54 comprises a first angular section or for blocking off the perforations 24 in the first angular range ϕ. The surface of the first angular section seals or blocks off air to the openings 26 in the first angular range ϕ, preventing air from passing through the chamber 25 in the first angular range ϕ. The radially outward surface 54 further comprises a second angular section with therein the opening 51 for blowing off leading edges of sheets S in the second angular range θ. The opening (or openings) 51 is preferably positioned within the second angular range θ to pressurize one or more chambers 25 in the second angular range θ. The pressurized chambers 25 emit air jets via the perforations 24 in the second angular range θ, thereby releasing leading edges of the sheets S in said range θ towards the guide plate 78. It will be appreciated that the upstream of the range θ, a further blocking range φ is provided. The range φ prevents a "short circuiting" of a chamber 25, such that air cannot be simultaneously blown into the chamber 25 through a first angularly upstream opening 51 connected to said chamber 25 and blown out through a second angularly downstream opening 51 connected to said chamber 25. The angular range φ prevents air blown into the chamber 25 from escaping into the inner chamber 22 when the chamber 25 is not positioned completely over the shutter member 50.

In FIG. 3, the substantially entire space or volume of the inner chamber 22 may be used to provide a low air resistance fluid connection between the suction opening 29 and the perforations 24. The inner chamber 22 is kept at a low or vacuum pressure by the suction system, thereby drawing in air through all perforations 24, except those blocked off by the shutter member 50.

Figure 4:
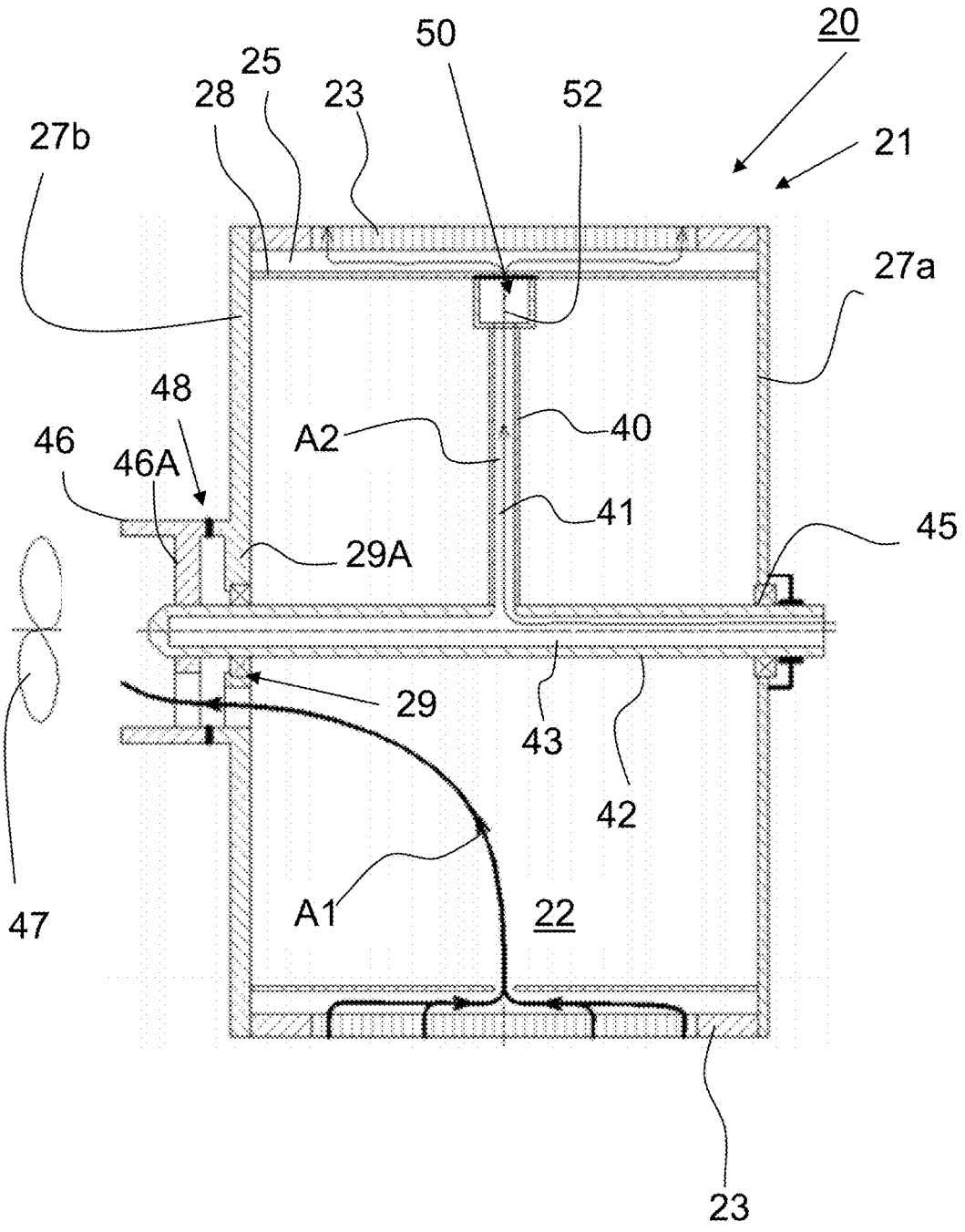
FIG. 4 is an axial cross-sectional view of the sheet handling apparatus in FIG. 3.

FIG. 4 shows a cross-section along the rotation axis 42 of the sheet handling apparatus 20. The drum 21 is substantially hollow and sealed at both axial ends by flanges 27*a, b*. The flanges 27*a, b* comprises axial openings 29 through which the rotation axis 42 extends. The left flange 27*b* in FIG. 4 comprises the suction opening 29, which is connected to the suction system 47 via the suction pipe 46. The suction pipe 46 comprises an angularly extending support section 46A similar to the support section 29A of the suction opening 29. The static suction pipe 46 is connected to the rotatable drum 21 via a sealing element 48. The sealing element 48 is arranged for preventing air from leaking into the suction pipe 46 or drum 21 while providing a low friction connection between the rotating drum 21 and the static suction pipe 46. Such a seal element 48 may, for example, be an oil seal. Thereby air A1 may drawn via the perforations 24 in the outer surface 23 of the drum 21 through the inner chamber 22 out of the drum 21 via the suction opening 29. The air flow A1 then passes through the suction pipe 46 to the suction system 47. By utilizing the inner chamber 22, the air flow A1 experiences little air resistance during its passage to the suction system 47.

The rotation axis 42 is stationary with respect to the frame of the printing system 1 and the drum 21 is rotatably supported on the rotation axis 42 by bearing elements 45, which may comprise e.g. roll or ball bearings. The support elements 45 or bearings provide a low friction support for the drum 21 on the static rotation axis 42. The rotation axis 42 comprises the axis conduit 43 which transports pressurized air to the shutter member 50 via the support member conduit 41. The openings 26 for the chambers 25 are preferably circumferential or peripherally aligned, e.g. in one or more circles on the inner peripheral wall 28. The openings 26 may then be positioned near the support member 40, such that the shutter member 50 need not cover the full axial width or length of the drum 21. Thereby, the dimensions of the shutter member 50 may be reduced. The shutter member may be dimensioned relatively narrow compared to the axial length of the drum 21.

FIG. 4 further shows the pressure source forcing a pressurized air flow or jet A2 into the rotation axis conduit 43 and then radially through the support member conduit 41 to a pressure chamber 52 in the shutter member 50. From the pressure chamber 52, the air flow A2 is forced out through the perforations 24 which at that moment are positioned over the outward openings 51 of the shutter member 50. The air emitted from the perforations 24 in the second angular range θ drives sheets S away from the drum 21 for an easy release. It will be appreciated that several shutter members 50 with their respective support members 40 may be axially spaced apart from one another to increase the homogeneity of the pressurized air flow in the axial chamber 25.

Figure 5:
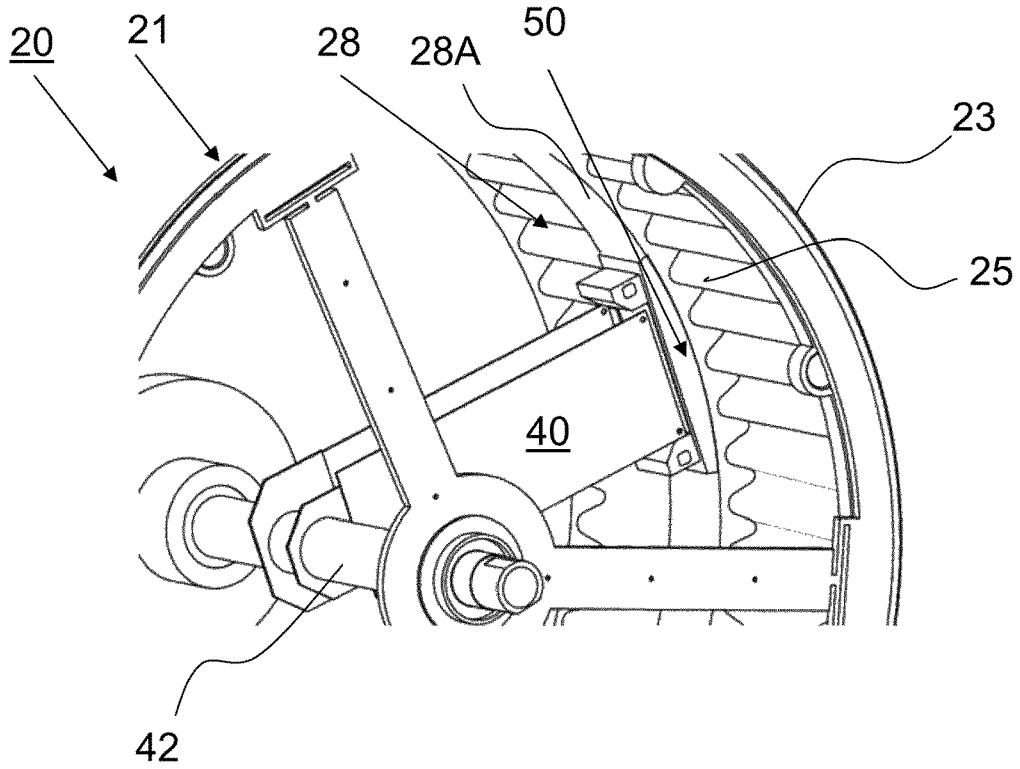
FIG. 5 is a perspective view of the sheet handling apparatus in FIGS. 3 and 4.

FIG. 5 illustrates a three dimensional view inside the drum 21. The shutter member 50 is positioned centrally inside the drum 21, as seen in the axial direction. The shutter member 50 is adjacent the inner peripheral wall 28, but not in contact therewith to eliminate friction, which is better illustrated in FIG. 6. FIG. 5 further shows the support member 40 extending radially from the static rotation axis 43 to position the shutter member 50 in the desired angular range θ, ϕ. The inner surface 28 comprises an angularly extending central or connection region 28A, positioned in correspondence to the shutter member 50. The connection region 28A comprises the openings 26 which for allowing air to pass from the axial chambers 25 into the inner chamber 22. By centrally positioning the openings 26 on the central region 28A, the shutter member 50 may dimensioned narrowly compared to the drum 21. Air is then axially transported from the openings 26 to the perforations 24 via the chambers 25.

Figure 6:
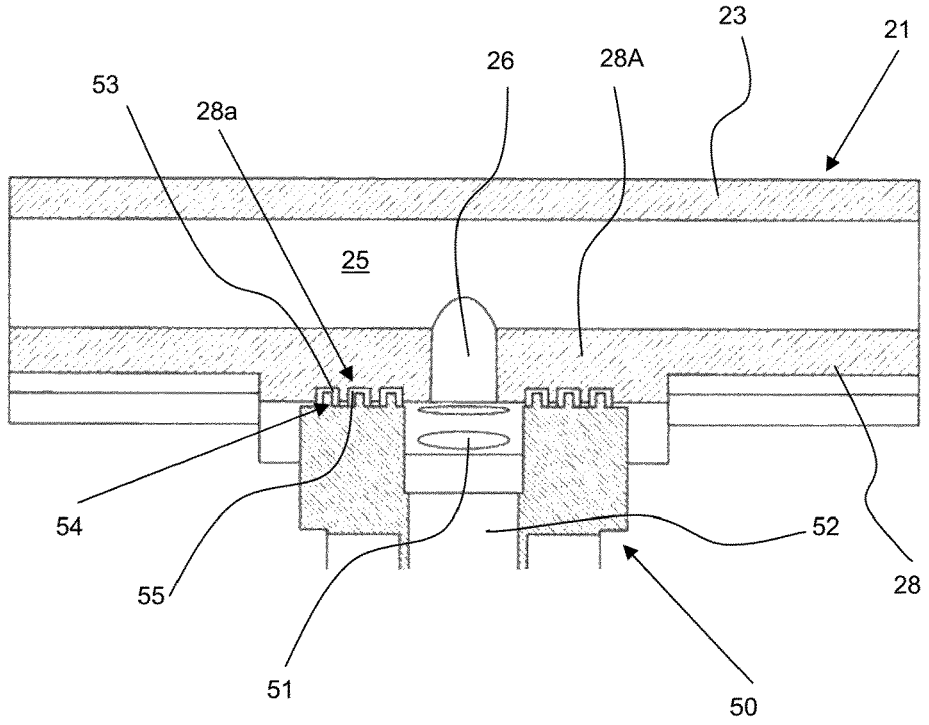
FIG. 6 is a cross-sectional view of the shutter member inside the drum in the sheet handling apparatus in FIG. 3.

FIG. 6 shows that the shutter member 50 is positioned at a narrow distance from the central region 28A on the inner peripheral wall 28 to reduce the amount of air leaking into the inner chamber 22 from the shutter member 50. The shutter member 50 in FIG. 6 comprises a pressure chamber 52 in fluid connection to the support member conduit 41 for receiving pressurized air. The pressure chamber 52 connects to the one or more openings 51, such that air may be blown from the pressure chamber 52 through the openings 51 into the chamber 25. The chamber 25 is then pressurized, which results in air jetting from the perforations 24 of said chamber 25. The air pushes against the sheet S driving it away from the peripheral wall 23 and onto the guide plate 78.

To maintain a proper vacuum in the inner chamber 22, air transport between the pressure chamber 52 and the inner chamber 22 must be prevented or reduced. Thereto, the present invention provides a labyrinth seal 53 between the radially outwards wall 54 of the shutter member 50 and the inner peripheral wall 28. The spacing between the outward wall 54 of the shutter member 50 and the inner peripheral wall 28, 28A of the drum 21 is very narrow to reduce the amount of air leaking between the two 54, 28, 28A. The air resistance is further improved by providing a plurality of protrusions or ribs 55 on the outer wall 54 of the shutter member 50. These protrusions 55 are dimensioned in correspondence to recesses 28*a* on the inner peripheral wall 28, specifically on the central region 28A. The protrusions or recesses 28*a* on the drum 21 extend circumferentially over the inner surface 28, such that the central region 28A comprises a similar or identical shape over the full angular range of the drum 21. A protrusion 55 is positioned in a close but contactless fit within a recess 28*a*, such that air is forced to flow through a narrow meandering air passage 53. Thereby, the air resistance of the seal 53 is increased and air leakage is reduced without adding friction between the drum 21 and the shutter member 50. It will be appreciated that within the scope of the present invention the recesses 28*a* may be positioned on the shutter member 50 while the protrusions 55 are positioned on the inner peripheral wall 28 or vice versa. In a preferred embodiment, the recesses 28*a* and the protrusions 55 are both formed by a plurality of protrusions on either surface 54, 28, 28A.

The ribs 55 extend angularly over a finite angle, e.g. θ and/or ϕ. The recesses or channels 28*a* extend endlessly over the inner surface 28 of the drum 21. Each channel 28*a* receives a rib 55 without contacting said rib 55. The pairs of ribs 55 and channels 28*a* are positioned side by side along the axial direction of the drum 21. As such, an oscillating air passage 53 is formed. The ribs 55 fit tightly yet contactlessly inside the channels 28*a*. Both the channels 28*a* and the ribs 55 extend in the circumferential direction and are smooth or continuous in said direction. While the channels 28*a* may be endless, the ribs 55 extend over a finite angle θ and/or ϕ. In FIG. 6, the air passage 53 is a narrow spacing 53 between the drum 21 and the shutter member 50, which air passage 53 repeatedly moves up and down with respect to the central axis of the drum 21. The narrow air passage 53 provides a local air resistance barrier 53 which reduces the amount of air leaking from the pressure chamber 52 to the inner chamber 28 of the drum 21. Since the shutter member 50 does not contact the rotary drum 21, the friction between them is substantially zero. The drum 21 may then be rotated at reduced driving power.

The drum 21 in FIGS. 3-6 comprises an outer and an inner peripheral wall 23, 28 for forming the chambers 25. The outer peripheral wall 23 may, in a preferred embodiment, be formed by a screen wrapped around the drum 21 as described in European patent application filed on 16 Nov. 2015 and published under number 3020666, which application, specifically the description of the screen, is herein incorporated by reference.

Figure 7:
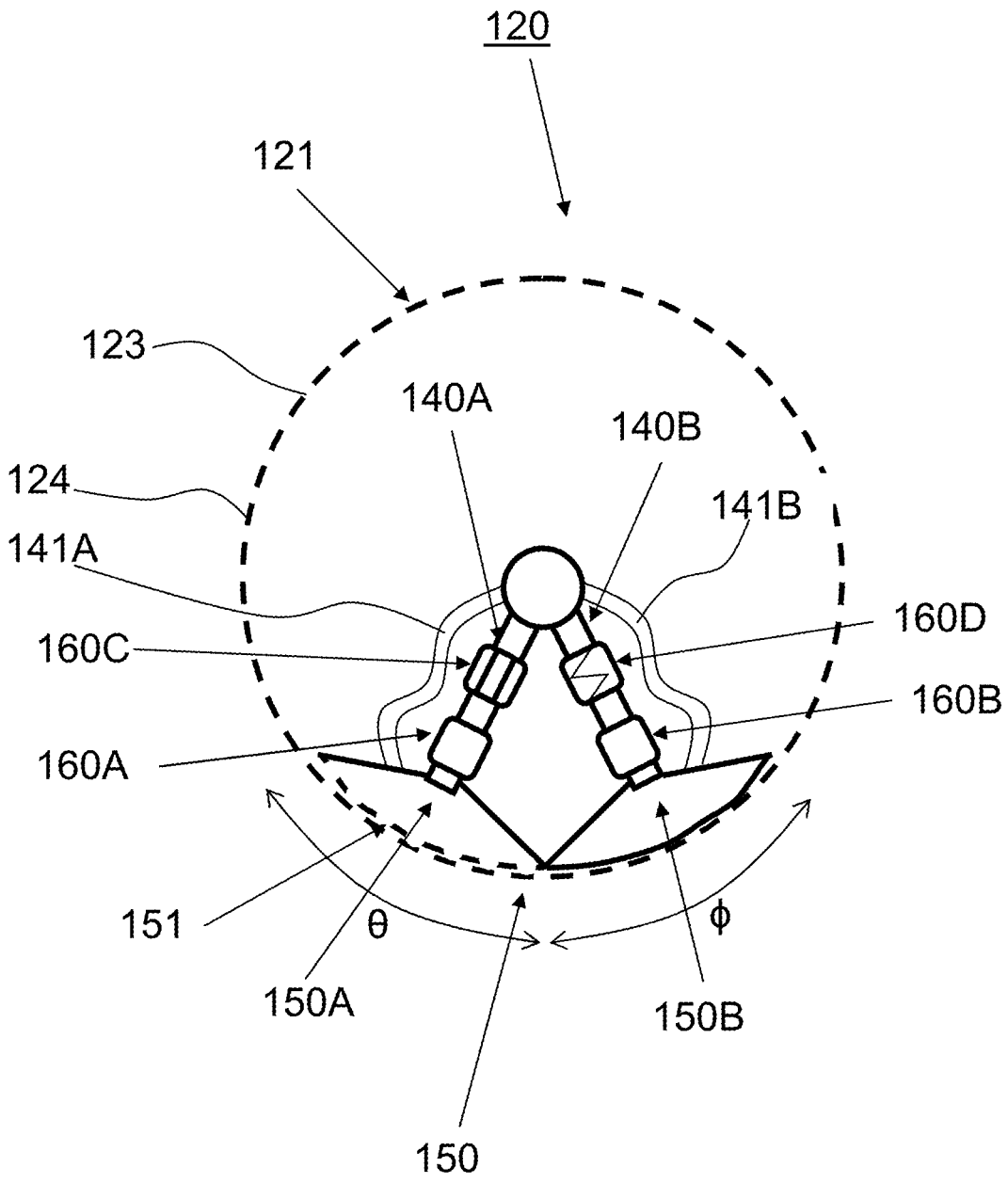
FIG. 7 is a schematic cross-sectional view of another embodiment of a sheet handling apparatus according to the present invention.

FIG. 7 shows an alternative embodiment of a sheet handling apparatus 120 according to the present invention. In contrast to the above described sheet handling apparatus 20, the drum 121 in FIG. 7 lacks the axially extending chambers 25 shown in FIG. 3. The outer surface of the circumferential wall 123 forms the outer peripheral surface or wall whereas the inner peripheral wall is formed by the inner surface of the wall 123. The perforations 124 extend through the single wall 123 into the inner chamber of the drum 121. The apparatus 120 comprises a shutter member assembly 150, comprising a plurality of shutter members 150A, 150B. The first and second shutter members 150A, 150B are preferably configured substantially similar to one another to reduce manufacturing costs. For example, the right shutter member 150B is shown without openings 151, but may in practice be a shutter member like the left shutter member 150A with openings 151, wherein during use no pressurized air is supplied to the openings 151.

In FIG. 7, the first shutter member 150A is provided with openings 151 through which pressurized air may be blown outwards through the perforations 124 in the drum 121 for releasing part of sheets S on the drum 121. The first shutter member 150A angularly covers the first angular range θ in which pressurized air A2 is ejected through the perforations 124 in the drum 121. The second shutter member 150B is positioned downstream of the first shutter member 150A in the direction of rotation of the drum 121. The second shutter member 150B has an outward surface substantially free of perforations 124 for blocking off air flow through the perforations 124. The second shutter member 150B covers the second angular range ϕ, which is positioned angularly adjacent to the first angular range θ. The shutter members 150A, 150B extend substantially over the axial width of the drum 121 (or at least the width of a sheet S on said drum 121). As such, the weight of the drum 121 may be further reduced and its construction simplified further. In FIG. 7, it can be seen that for each shutter member 150A, 150B a first positioning mechanism 160A, 160B is provided on the respective support members. The first positioning mechanisms 160A, 160B allow the operator to accurately determine and fix the position of the shutter members 150A, 150B with respect to the drum 121 to ensure that a proper yet contactless labyrinth seal is established. Thereto, the first positioning mechanisms 160A, 160B may allow a fine and controlled movement of the shutter members 150A, 150B in the axial and/or radial directions. Additionally the shutter members 150A, 150B may during assembly be arranged to rotate on the first positioning mechanisms 160A, 160B e.g. around a radial axis formed by the support member. As such, the shutter member 50, 150, support member 40, and/or the rotation axis 42 may be configured to be moveable during the assembly of the apparatus 20, 120 according to the present invention, while during operation (i.e. during a print job) said components are stationary.

In FIG. 7, the left support member 140A is provided with a second positioning mechanism 160C for compensating thermal expansion displacement of the drum 121. At the start of operation the drum 121 is heated and expands thereby positioning its radially inner surface further away from the shutter member 150A. Thus, the spacing between the shutter member 150A and the inner surface of the drum 121 increases, resulting in an increased air leak into the inner chamber of the drum 121. To compensate for said thermal expansion, the second positioning mechanism 160C comprises an actuator for radially positioning the shutter member 150A. In one example, the second positioning mechanism 160C comprises an electric or pneumatic actuator which sets the radial position of the shutter member 150A in response to the temperature of the drum 121, as determined by means of one or more temperature sensors. In another preferred embodiment, the second positioning mechanism 160C comprises a thermal expansion device which expands radially correspondingly to the expansion of the drum 121, such that during heating and thermal expansion the shutter member 150A and the inner surface of the drum 121 maintain substantially the same spacing with respect to the one another.

The shutter member 150B on the right side of FIG. 7 is provided with a third positioning mechanism 160C, which comprises urging means 160C for driving the shutter member 150B towards the inner surface of the drum 121. The shutter member 150B is preferably provided with rollers to provide a low friction contact between the drum 121 and the shutter member 150B, while accurately maintaining the desired spacing required for labyrinth seal. It will be appreciated that during operation both shutter members 150A, 150B are stationary in the angular direction, and preferably in the axial direction of the drum 121 as well. To allow for the radial displacement of the shutter members 150A, 150B, the support member conduit 141A, 141B is provided as a flexible conduit, in the form of a hose or line. It will be appreciated that any of the positioning mechanisms 160A-D and/or the flexible support member conduits 141A-B may be applied in the embodiments shown in FIGS. 3-6.

Detailed embodiments of the present invention are disclosed herein; however, it is to be understood that the disclosed embodiments are merely exemplary of the invention, which can be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure. In particular, features presented and described in separate dependent claims may be applied in combination and any advantageous combination of such claims are herewith disclosed.

Further, it is contemplated that structural elements may be generated by application of three-dimensional (3D) printing techniques. Therefore, any reference to a structural element is intended to encompass any computer executable instructions that instruct a computer to generate such a structural element by three-dimensional printing techniques or similar computer controlled manufacturing techniques. Furthermore, such a reference to a structural element encompasses a computer readable medium carrying such computer executable instructions.

Further, the terms and phrases used herein are not intended to be limiting; but rather, to provide an understandable description of the invention. The terms "a" or "an", as used herein, are defined as one or more than one. The term plurality, as used herein, is defined as two or more than two. The term another, as used herein, is defined as at least a second or more. The terms including and/or having, as used herein, are defined as comprising (i.e., open language). The term coupled, as used herein, is defined as connected, although not necessarily directly.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

The invention claimed is:

1. A sheet handling apparatus comprising:

a rotary drum having an inner chamber circumferentially surrounded by an outer peripheral wall with perforations formed therein;

a suction system for controlling a flow of air through the perforations of the drum, thereby to attract sheets to the peripheral wall of the drum; and a shutter member positioned inside the inner chamber for blocking the flow of air through the perforations when they pass, with the rotation of the drum, through a first predetermined angular range, wherein a radially outward surface of the shutter member comprises a plurality of protrusions and a radially inward surface of the rotary drum comprises plurality of recesses for receiving the protrusions, such that a meandering air flow passage is formed between the shutter member and the rotary drum, wherein the protrusions are spaced apart from one another in an axial direction of the drum, and wherein the recesses are spaced apart from one another in the axial direction of the drum.

2. The apparatus according to claim 1, wherein the meandering air flow passage forms an air flow resistance element to prevent substantial amounts of air from flowing from inside the shutter member into the inner chamber of the rotary drum.

3. The apparatus according to claim 1, wherein each protrusion and recess extends over a predefined angle in a circumferential direction of the drum.

4. The apparatus according to claim 1, wherein each protrusion is shaped to contactlessly fit into a corresponding recess.

5. The apparatus according to claim 1, wherein the meandering air flow passage spaces the radially inward surface of the drum apart from the shutter member by a narrow distance of less than 5 mm.

6. The apparatus according to claim 1, wherein the rotary drum is rotatably supported on a stationary frame of the sheet handling apparatus, and a stationary support member extends inside the drum to connect the shutter member inside the rotary drum to the stationary frame.

7. The apparatus according to claim 6, wherein the rotary drum is rotatably supported on a stationary rotation axis, wherein the stationary support member connects the shutter member to the stationary rotation axis.

8. The apparatus according to claim 1, wherein the rotary drum further comprises a flange at each axial end of the rotary drum, and wherein one of the flanges comprises a suction opening for connecting the inner chamber to the suction system.

9. The apparatus according to claim 7, wherein the stationary rotation axis extends into the inner chamber through a suction opening.

10. The apparatus according to claim 1, further comprising a pressure source for introducing compressed air into the shutter member, which shutter member is arranged for providing a flow of air through the perforations when they pass, with the rotation of the drum, through a second predetermined angular range.

11. The apparatus according to claim 10, further comprising a support member conduit for providing an air flow from the pressure source to the shutter member.

12. The apparatus according to claim 7, wherein the stationary rotation axis comprises an axis conduit in fluid connection with a support member conduit for providing an air flow from a pressure source to the shutter member.

13. A printing system comprising the sheet handling apparatus according to claim 1.

14. The apparatus according to claim 1, wherein the plurality of protrusions extend radially outwardly and the plurality of recesses for receiving the protrusions extend radially.

15. The apparatus according to claim 1, wherein the meandering air flow passage extends in an axial direction of the drum.

16. The apparatus according to claim 1, wherein the meandering air flow passage is formed between the radially outward surface of the shutter member and the radially inward surface of the rotary drum.

17. The apparatus according to claim 1, wherein the inner chamber forms a fluid connection between the perforations in the outer peripheral wall of the drum and the suction system, such that during operation air is sucked in through the perforations into the inner chamber.

18. The apparatus according to claim 1, wherein the meandering air flow passage is formed by a labyrinth seal between the radially outward surface of the shutter member and the radially inward surface of the drum.

* * * * *